United States Patent [19]

Dahlquist

[11] 4,058,108

[45] Nov. 15, 1977

[54] GRATE

[75] Inventor: Emil F. Dahlquist, Clinton, Conn.

[73] Assignee: Radiant Grate, Inc., Clinton, Conn.

[21] Appl. No.: 611,008

[22] Filed: Sept. 8, 1975

[51] Int. Cl.[2] ..... F23H 13/02

[52] U.S. Cl. ..... 126/137; 126/165; 126/298; 126/336

[58] Field of Search ..... 126/164, 165, 126, 137, 126/298, 336, 92 B, 92 AC, 141; D7/136

[56] References Cited

U.S. PATENT DOCUMENTS

| | | | |
|---|---|---|---|
| 99,581 | 2/1870 | McElevey | 126/164 |
| 538,511 | 4/1895 | Glud | 126/164 |
| 757,595 | 4/1904 | Bostel | 126/141 |
| 1,943,209 | 1/1934 | Davis | 126/164 |
| 2,600,753 | 6/1952 | Gilbert | 126/298 |
| 3,771,511 | 11/1973 | Dahlquist | 126/165 |
| Re. 28,586 | 10/1975 | Dahlquist | 126/165 |

*Primary Examiner*—John J. Camby
*Assistant Examiner*—Larry I. Schwartz
*Attorney, Agent, or Firm*—DeLio and Montgomery

[57] ABSTRACT

A log-burning grate comprising a log-supporting portion and a log-retaining portion disposed at essentially ninety degrees to each other and supported by legs above a base plane with the support portion comprising a plurality of spaced apart members disposed at an angle of twenty to thirty degrees to the horizontal. A plate member is mounted to the retaining portion to control the position of the buildup of an ember bed, to slow the rate of burn, and to protect the back fireplace wall. The support members are spaced a sufficient distance to allow embers from logs in the grate to fall through and form a bed thereunder, the total area of spacing between said supporting members being substantially greater than the area of said supporting members so as to permit heat due to burning of logs in said grate to radiate outwardly from the front of the grate.

2 Claims, 3 Drawing Figures

GRATE

This invention relates to grates and more particularly relates to grates adapted to be used in a fireplace or other combustion area.

The grate of this invention is an improvement over that disclosed in U.S. Pat. No. 3,771,511.

The grate disclosed in U.S. Pat. No. 3,771,511 is one in which one log-supporting portion is angled to the horizontal to such an extent that as the logs supported thereon are consumed, the underside of the logs will be exposed and will provide a source of radiant heat. As embers fall from the log, a bed of burning embers will be established below the grate which will further define together with the burning logs a source of radiant energy. Such a fireplace grate increases the direct radiation of heat from the burning logs without the usual time delay required in heating the firebrick defining a fireplace.

Such grates are preferably fabricated from bar stock of ⅝ inch. In some applications, where the grate has been used extensively, there has been a softening of the metal in the areas of high heat, and additionally some ember buildup at the back of the fireplace. This may cause undesired heating of the back wall.

The present invention provides a new and improved grate construction which alleviates the aforementioned problems while enhancing the buildup of an ember bed which contributes to the forwardly radiated heat, and further partially limits flow of air to the logs to cause a slower burn.

Briefly stated, the invention in one form thereof comprises a grate having a log-supporting portion and a log-retaining portion substantially perpendicular to each other. The log-supporting portion comprises essentially parallel members spaced sufficiently apart to permit embers from burning logs to fall to the fireplace floor, and to permit energy from the embers to radiate from the fireplace. The log-supporting portion is angled at about twenty to thirty degrees from the horizontal and supported from the juncture with the log-retaining portion a sufficient distance above the fireplace floor to permit a buildup of embers thereunder. The backwardly extending log-retaining portion serves to space the grate from the back fireplace wall. A plate covers the log-retaining portion and provides a three-fold function of spacing all combustion forward of the back wall, directing the falling embers beneath the log-burning portion, and obstructing radiation of heat backwardly, and slowing the rate of burn. The absorbing of heat and decrease in the rate of burn prevents softening of the grate at the juncture of the log supporting and retaining portion during continued exposure to heat.

The features of the invention which are believed to be novel are particularly pointed out and distinctly claimed in the concluding portion of this specification. The invention, however, both as to its operation and organization, together with further objects and advantages thereof, may best be appreciated by reference to the following detailed description taken in conjunction with the drawings, wherein:

A grate 10 according to the invention comprises a log-supporting portion 11, and a log-retaining portion 12. The log-supporting portion 11 and log-retaining portion 12 are at essentially 90° to each other, with the log-supporting portion 11 inclined between 20° and 30° to the horizontal.

Figure 1:
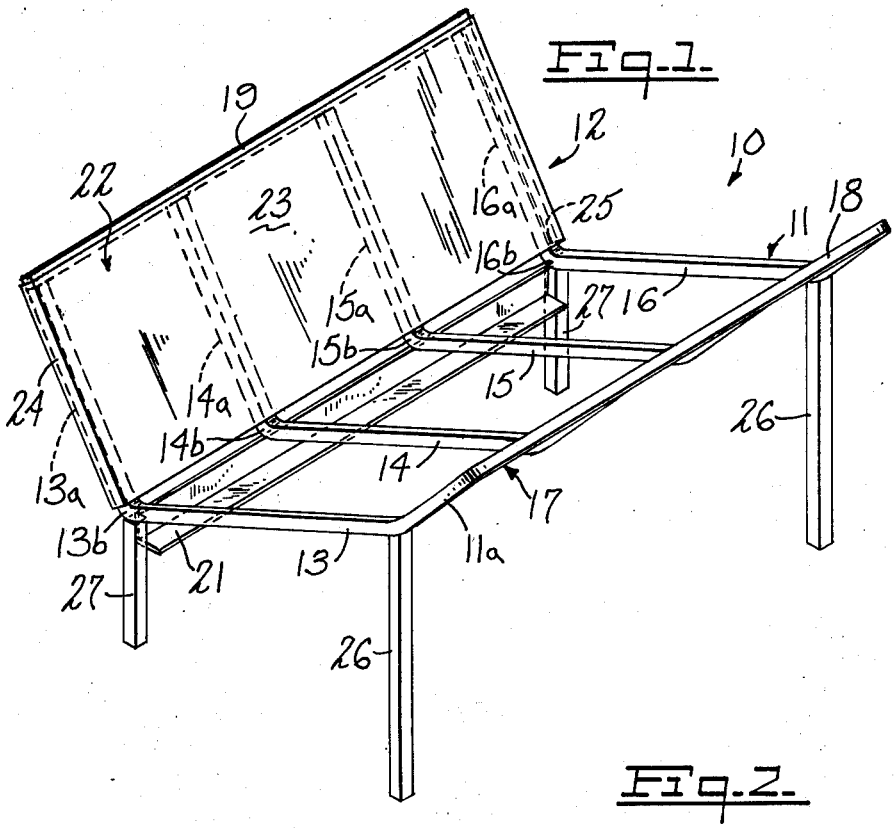
FIG. 1 is a perspective view of a grate embodying the invention.
Figure 2:
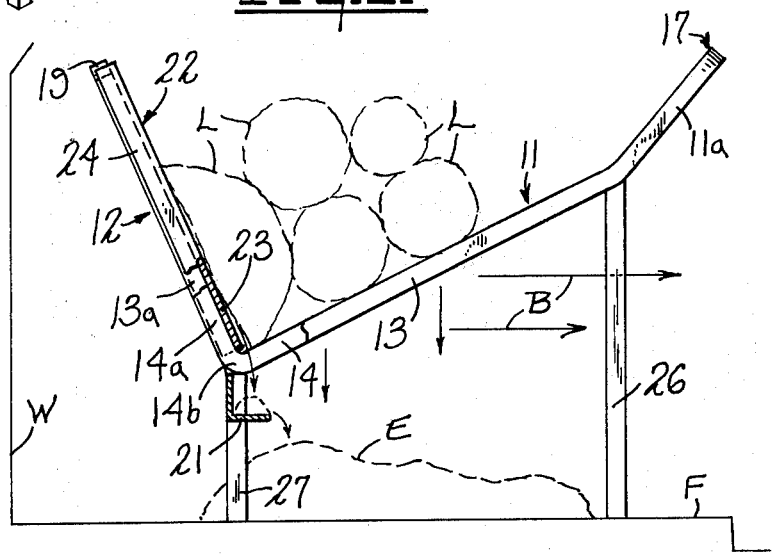
FIG. 2 is a side elevation of the grate of FIG. 1.

The supporting portion comprises support members 13, 14, 15 and 16 spaced apart a sufficient distance to permit embers from logs L to fall to the floor F of a fireplace having a back wall W. These members are also spaced apart a sufficient distance to permit radiation of heat from burning logs therein to exit from the underside of the grate as shown by the arrows B. Members 13 and 16 as shown are part of a generally U-shaped member 17 which includes log-support members 13 and 16 joined by portion 18. Member 17 is bent as shown in FIG. 1 so that the extending arms **13*a* and 16*a*** provide a portion of the log-retaining portion.

Log-support portion 12 is comprised of essentially parallel members **13*a*, 14*a*, 15*a*, and 16*a*, which are extensions of members 13, 14, 15 and 16, respectively. A bridging member 19 is affixed to the upper ends of members 13*a*–16*a*. The outer end of support portion 11 is preferably bent upwardly as a retaining lip 11*a***.

A stiffening member in the form of an angle 21 extends along the outside of the bends **13*b*–16*b*. The lower flange of angle 21** provides a support for a food-carrying member as disclosed in U.S. Pat. No. 3,771,511.

The members 13, 14, 15 and 16 are spaced apart a sufficient distance to enable embers from the logs L to fall through and build up a pile of embers E. The pile of embers E, together with the burning wood on the log-supporting portion define a radiant heat source and heat is radiated outwardly from the fireplace as indicated by the arrows B.

Figure 3:
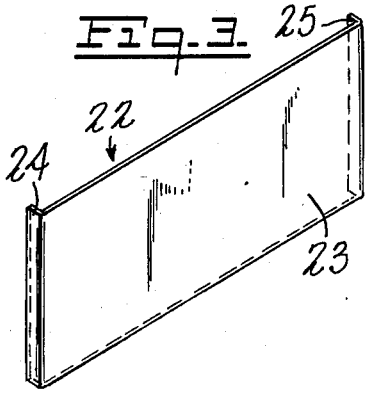
FIG. 3 is a perspective view of a portion of the grate of FIGS. 1 and 2.

In accordance with the invention, means are provided which slow the rate of burn of the fuel against the log retaining portion of the grate, aid in keeping the back of the grate cool and direct the buildup of embers to a position below the log-suporting portion. As used herein the term fuel includes the burning logs and charcoal formed thereby. A plate-like member 22 (FIG. 3) is provided to fit over log-retaining portion 12. Member 22 has a flat portion 23 which rests against members **13*a*–16*a*, and end positioning flanges 24 and 25 which at least partially fit about members 13*a* and 16*a***.

Member 22 acts as a baffle to prevent unrestricted flow of air toward the fuel and thus slows the rate of burn adjacent the retaining section. Member 22 also blocks radiation of heat toward the back wall W of the fireplace and permits circulation of cooler air therebehind. This prevents damage to the fireplace wall W over a period of time. Additionally, member 22 directs embers from the rear of the fireplace to fall into an ember pile E. Member 22 further acts as a heat sink to absorb heat from the burning logs which would otherwise be transferred to the grate. Member 22 is preferably imperforate but could be made with some openings therein for passage of air if deemed advisable.

Front legs 26 extend downwardly from support portion 11 and rear legs 27 extend downwardly from the bends at the juncture of the supporting and retaining portions.

With this arrangement, as the logs are consumed, and as the ember bed E is built up, there will be a substantial radiation of heat as indicated by the arrows B from the burning underside of the logs L and from the bed E. This construction further provides substantial clearance for convection and circulation of air beneath the logs and therebetween to enhance combustion.

In practice, it has been found that the lowermost logs in the grate will burn at a very high temperature and will be rapidly consumed without member 22 while the outer logs adjacent their upper surfaces will be relatively cool. However, with member 22 in position the circulation of air to the combustion area is impeded and the rate of burn is decreased. As the lower logs are consumed, the high angle of disposition of the support portion 11 will cause the remaining logs to slide downwardly toward the juncture of the retaining and support portions.

The front and rear supporting legs 26 and 27 are chosen in length to provide about a preferred 25° angle and further to hold the grate a sufficient distance above the supporting base so that there is a definite and decided spacing between the underside of the supported logs and the base or the ember bed that builds up on the base. There should be a minimum of three inches length of legs 27. Moreover, the space and hence the area defined between the log-support members is large as compared to the area of the underside of members 13–16 so that the area of the burning logs is maximized for radiation purposes.

The space between the back of the grate and the wall W may be filled with burned out ash if desired to provide further insulation for the wall W.

For purposes of example only, in one embodiment of the invention, the members 13 may be formed from ⅝ inch bar stock with spacings of three and one-half inches therebetween, and the length of portion 11 (excluding lip 11*a*) made to be about twelve inches. The front legs 26 are eight and one-half inches and the rear legs 27 are 4 inches. Lip 11*a* is about 3 inches. Retaining portion 12 is eight inches in length.

It may thus be seen that the objects of the invention set forth as well as those made apparent from the preceding description are efficiently attained. While a preferred embodiment of the invention has been set forth for purposes of disclosure further embodiments of the invention as well as modifications to the disclosed embodiment which do not depart from the spirit and scope of the invention may occur to others skilled in the art. Accordingly, the appended claims are intended to cover all embodiments and modifications of the invention which do not depart from the spirit and scope of the invention.

What is claimed is:

1. A grate comprising a log-supporting portion and a log-retaining portion, said log-supporting portion comprising a plurality of spaced apart members disposed at an angle of 20° to 30° to the horizontal, said retaining portion extending from said supporting members at an angle therewith of essentially 90°, said supporting members being spaced apart a sufficient distance to allow embers from logs in said grate to fall through and form a bed thereunder, the total area of spacing between said supporting members being substantially greater than the area of said supporting members so as to permit heat due to burning of logs in said grate to radiate outwardly from the front of said grate, and a removable plate-like wall member disposed over said retaining portion, and legs supporting said grate above a base plane a sufficient distance to permit buildup of an ember bed on the base plane beneath said supporting portion while leaving a defined space between the underside of said log-supporting portion and a formed ember bed whereby embers from said grate will fall from said grate essentially in front of said retaining portion, said plate-like member having end flanges which fit about the ends of said log-retaining portion.

2. The grate of claim 1 wherein an edge of said plate-like member rests at the apex of the essentially 90° angle defined by said log-supporting and log-retaining portions.

* * * * *